US005186469A

United States Patent [19]

Terris

[11] Patent Number: 5,186,469

[45] Date of Patent: Feb. 16, 1993

[54] FOLDABLE SOCCER GOAL FOR EASY STORAGE

[76] Inventor: George Terris, 44 Floyd Ave., Tewksbury, Mass. 01876

[21] Appl. No.: 805,015

[22] Filed: Dec. 11, 1991

[51] Int. Cl.[5] ..... A63B 63/04

[52] U.S. Cl. ..... 273/400; 273/411

[58] Field of Search ..... 273/398, 400, 401, 402, 273/411

[56] References Cited

U.S. PATENT DOCUMENTS

| | | | |
|---|---|---|---|
| 3,822,883 | 7/1974 | De Vos | 273/411 X |
| 3,938,806 | 2/1976 | Husbanos | 273/411 |
| 4,083,561 | 4/1978 | Daffer, Jr. | 273/411 X |
| 4,127,272 | 11/1978 | Pennell | 273/398 |
| 4,286,786 | 9/1981 | Papadopoulos | 273/411 X |
| 4,407,507 | 10/1983 | Caruso et al. | 273/400 |
| 4,478,420 | 10/1984 | Sowards | 273/411 |
| 4,615,528 | 10/1986 | York | 273/411 X |
| 4,842,284 | 6/1989 | Rushing et al. | 273/411 X |
| 5,080,375 | 1/1992 | Moosavi | 273/400 |

*Primary Examiner*—William H. Grieb

*Attorney, Agent, or Firm*—Pearson & Pearson

[57] ABSTRACT

A foldable soccer goal has a U-shaped open ended frame in which the legs of the frame form goal posts and a cross connecting base element forms a cross bar. An open-ended U-shaped housing has a corresponding shape and the free ends of the legs forming the frame and housing connect at a pivot. Toggle mechanism span respective legs of the frame and housing. The housing mounts to the ground. When the frame pivots to be coplanar with the housing, it nests within the housing. When the frame pivots to a vertical position, it pulls a net structure from a roller in the housing to form a soccer goal.

13 Claims, 8 Drawing Sheets

FOLDABLE SOCCER GOAL FOR EASY STORAGE

BACKGROUND OF THE INVENTION

1. Field of the Invention

The present invention relates to soccer goals, and more particularly to a soccer goal that is easily collapsed for storage.

2. Background of the Invention

Soccer, probably the most popular game in the world, is on a playing field having two goals at opposed ends. Opposing teams try to kick a soccer ball through opposite goals against the defense of their opponents. A standard goal in the United States has an opening between vertical goal posts of eight yards and an opening between horizontal cross bars and the ground of three yards. The dimensions of the posts and cross bar may not exceed five inches. Thus the aspect ratio of the goal is three to one. Generally speaking, the goals may be 5.4 meters to 7.2 meters wide and 1.8 meters to 2.4 meters high, although the aspect ratio is preferably maintained. Usually a net is supported behind the cross bar and posts, i.e., on the side opposite the playing field ends, and at the sides to retain a ball kicked into the goal.

A typical soccer goal comprises a rigid frame that includes some depending structure that penetrates the ground to maintain the goal in a fixed horizontal position, and to support a net. Soccer goals with this construction have two characteristics. First, it is relatively easy for individuals to grab the cross bar and exert enough leverage to topple the goal. Second, these goals are found in large fields and people often walk across these fields. At night, particularly, goals are not readily visible, so it is possible for an individual to walk into the goal unintentionally.

There have been a number of alternative goal structures proposed. The following references are examples.

U.S. Pat. No. 3,822,883 to De Vos dated Jul. 29, 1974, for COMPARTMENTED NET TARGET AND PLAY FIELD shows a playing net for a game and a frame 11 that may be constructed permanently or assembled in a collapsible manner.

U.S. Pat. No. 4,127,272 to Pennell dated Nov. 28, 1978, for PORTABLE SOCCER GOAL shows a portable soccer goal that may be disassembled for easy transport.

U.S. Pat. No. 4,286,786 to Papadopoulos dated Sep. 1, 1981, for SOCCER TRAINING GOAL shows a goal frame, a net, and an inclined plate for returning a ball kicked into the net. The inclination of the plate may be adjusted.

U.S. Pat. No. 4,478,420 to Sowards dated Oct. 23, 1984, for SOCCER TRAINING AND PRACTICE DEVICE shows practice device having a netting for returning the ball and elastic ball retaining cords.

U.S. Pat. No. 4,615,528 to York dated Oct. 7, 1986, for SOCCER TRAINING DEVICE shows a frame with a netting for returning a ball kicked in practice and having a brace 16.

U.S. Pat. No. 4,842,284 to Rushing et al. dated Jun. 27, 1989, for CENTER SOCCER TWO WAY GOAL shows a goal staked into the ground for a somewhat soccer-like game.

None of these references discloses a structure that is adapted for overcoming the detrimental aspects of conventional goals and is adapted for use on regulation soccer fields. The De Vos patent discloses a game with parts that are assembled in advance of playing the game or that are assembled permanently. The Pennell patent discloses a soccer goal that must be completely disassembled. The Reisling et al patent discloses a collapsible goal, but requires a disconnection of parts. The remaining patents disclose structures that are not readily collapsible without disassembly. None of these structures provides or suggests a collapsible structure that is adapted for soccer goals and that minimizes efforts to collapse the goal for storage, particularly at the soccer goal site.

SUMMARY OF THE INVENTION

Therefore, it is an object of this invention to provide a soccer goal constructed for facilitating the collapse of the soccer goal into a storage position.

It is another object of this invention to provide a collapsible soccer goal that is easy to install and erect.

Still another object of this invention is to provide a soccer goal that collapses into a profile that is flush with the ground.

In accordance with this invention, a soccer goal comprises a U-shaped structure that forms the upstanding goal posts and cross bar at the front of a soccer goal. A U-shaped channel member having a corresponding form lies on or in the ground. The free ends of the U-shaped structure and channel pivot about a common axis. In a collapsed position, the U-shaped structure nests in the U-shaped channel, so the soccer goal has a thin, plate-like profile that can be flush with the ground. In an erect position, the U-shaped structure lies in a vertical plane. A collapsible toggle extends between the structure and channel to lock the structure in its erect position.

BRIEF DESCRIPTION OF THE DRAWINGS

The objects, advantages, and novel features of the invention will be more fully apparent from the following detailed description when read in connection with the accompanying drawing in which like reference numerals refer to like parts and in which.

DESCRIPTION OF AN ILLUSTRATIVE EMBODIMENT

Figure 1:
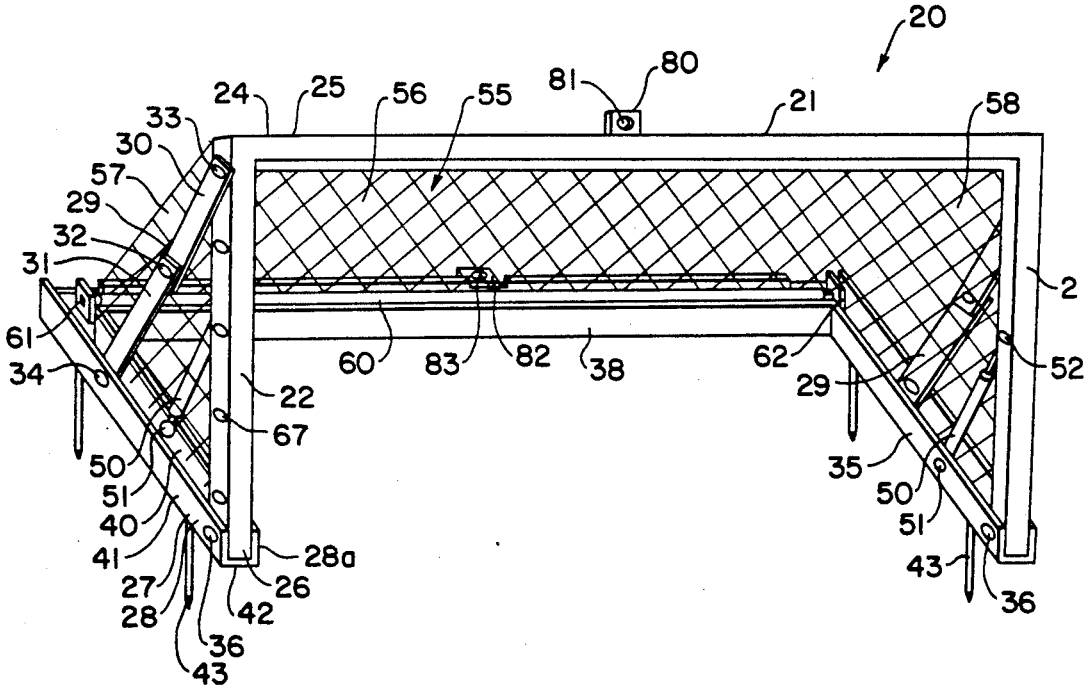
FIG. 1 is perspective view of one embodiment of a soccer goal that embodies this invention shown in an erect orientation.

Referring to the FIGures and particularly FIG. 1, a soccer goal 20 constructed in accordance with this invention has a longitudinally extending cross bar 21 connected between a pair of goal posts, namely a left goal post 22 and a right goal post 23. The goal posts 22 and 23 and the cross bar 21 may be formed separately or integrally to produce a U-shaped, open-ended frame structure. The left goal post 22 has an upper end 24 connected to the left end 25 of the cross bar 20. At its other, lower end 26, the post 22 connects for relative rotation to a U-shaped channel member 27. One leg 28 of the channel member 27 has a free end 28*a* that receives the lower end 26 of the post 22.

A toggle mechanism 29 includes upper and lower toggle arms 30 and 31 respectively that connect at a central toggle pivot 32. At its other, opposed end, an end pivot 33 connects the upper arm 30 for relative rotation to the upper end 24 of the post 22 and thereby to the left end 25 of the cross bar 21 A end pivot 34 of the lower toggle arm 30, remote from the toggle pivot 32, connects the lower toggle arm 30 for relative rotation to the base member 27. There is a similar toggle assembly at the right goal post 23 where identical reference numbers correspond to similar elements; that is, there is a toggle mechanism 29 between the upright goal post 23 and a leg 35 of the base channel member 27 that parallels the leg 28.

The end pivot points 33 and 34 typically are equidistantly spaced from a pivot 36 at the juncture of the upright goal post 23 and the base member 35 forming an right triangle. As apparent, each of the toggle arms 30 and 31 will have an effective length of 70.7% of the distance between the pivot 36 and the end pivot 34 when the goal is erect. This enables the toggle mechanism 29 to support the goal post 22 in an upright position, while folding to a closed position with a length that is less than the distance between the end pivot 34 and pivot 36.

Figure 3:
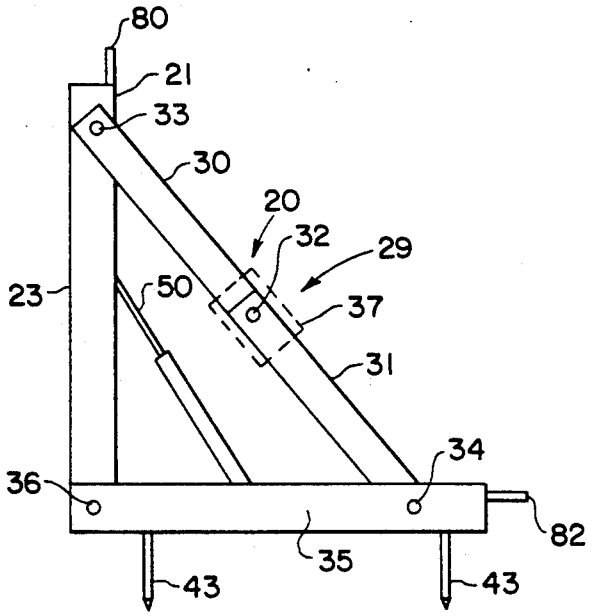
FIG. 3 is a side view of the soccer goal in FIG. 1.

It is important to lock the toggles 29 in a fully extended orientation in use. For example, a sleeve 37, as indicated by a dashed line in FIG. 3, can interact with a non-uniform thickness or width of the toggle arms 30 and 31 to control the position of the sleeve 37. The sleeve 37 would be coextensive with a portion of one of the toggle arms in an unlocked position. The sleeve would slide to overlap the central pivot and portions of the adjacent toggle arms 30 and 31 to lock the arms in the position shown in FIGS. 1 and 3. Alternatively, the toggle arms 30 and 31 may be formed with interlocking portions as found in brace structures for table legs and the like. Holes bored through the toggle arms 30 and 31 could align when the goal post 23 is erect and receive a locking pin or ring. There are still other structures that can be applied to provide this locking function for the toggle mechanism 29.

Figure 6:
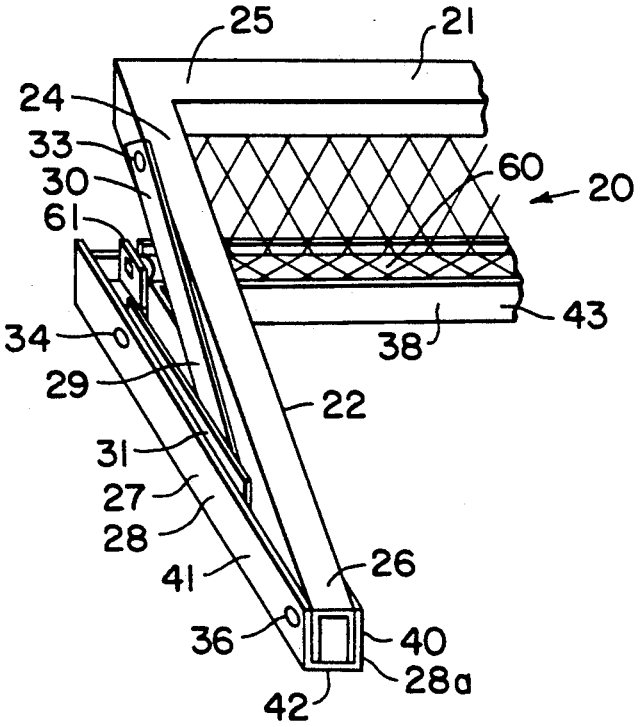
FIG. 6 is a perspective view of the soccer goal in a nearly fully collapsed position.
Figure 8:
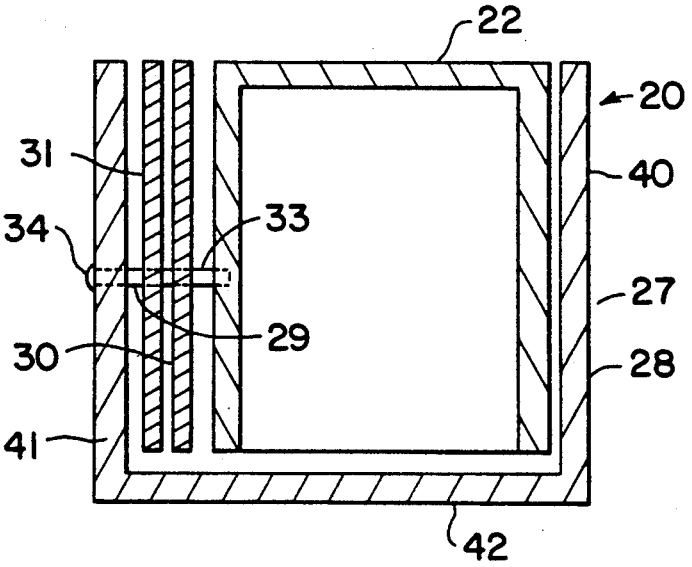
FIG. 8 is a cross-sectional view taken along lines 8—8 of FIG. 7.

The base member 27 has a "U" shape with legs 28 and 35 extending from a base 38 to form a U-shaped open-ended housing. Each of the legs 28 and 35 and base 38 has a U-shaped cross-section with inner and outer walls 40 and 41 and a bottom wall 42 as particularly shown in FIGS. 1, 8 and 13. Referring to FIGS. 1, 6 and 8, the lower end 26 of the goal post 22 connects for relative rotation to the inner wall 40 at one end 28*a* of the leg 28. The lower end of the goal post 23 connects to the leg 35 at the pivot 36. As shown particularly in FIGS. 1 and 2, the U-shaped base channel member 27 defines an open rectangular channel in a horizontal plane that receives the cross bar 21 and goal posts 22 and 23 in a nested relationship in the U-shaped recess that the walls 40, 41 and 42 form. This is shown in FIGS. 1, 6, 8, 9 and 14.

Ground pegs or spikes 43 depend from the bottom 42 of the channel member 27 to engage the ground and stabilize the goal posts 20 in a horizontal plane. Thus, as particularly shown in FIGS. 9 and 14, when the goal posts 22 and 23 and cross arm 21 are pivoted to a horizontal position, they nest in the open top channel formed by the base member 27 and the entire goal post structure is then flush with the ground 44.

Referring again to FIGS. 1 and 3 through 5, it is possible to facilitate the action of pivoting the goal post 22 and 23 and cross bar 21 between the horizontal and vertical positions by attaching gas cylinders 50 to each of the goal posts 22 and 23. As shown, the gas cylinders 50 connect at a lower pivot 51 at an intermediate portion along each of the legs 28 and 35. An upper pivot 52 attaches to a mid portion on each of goal posts 22 and 23 respectively. Such gas cylinders perform two functions. When the goal post rotates to a horizontal position, the gas cylinders 50 tend to resist the change thereby to provide a controlled rotation to the horizontal position. When the goal posts are raised, the gas cylinders 50 produce an upward force on the goal posts 22 and 23 to assist during the erection process.

Referring to FIGS. 1, 2, 4 and 11 through 13, the goal post 20 additionally has a net 55. When the goal posts are in an erect position as shown particularly in FIG. 1, the net has a back portion 56 and a side portions 57 and 58. Thus the structure shown in FIG. 1 provides a fully-enclosed goal structure for soccer.

Figure 4:
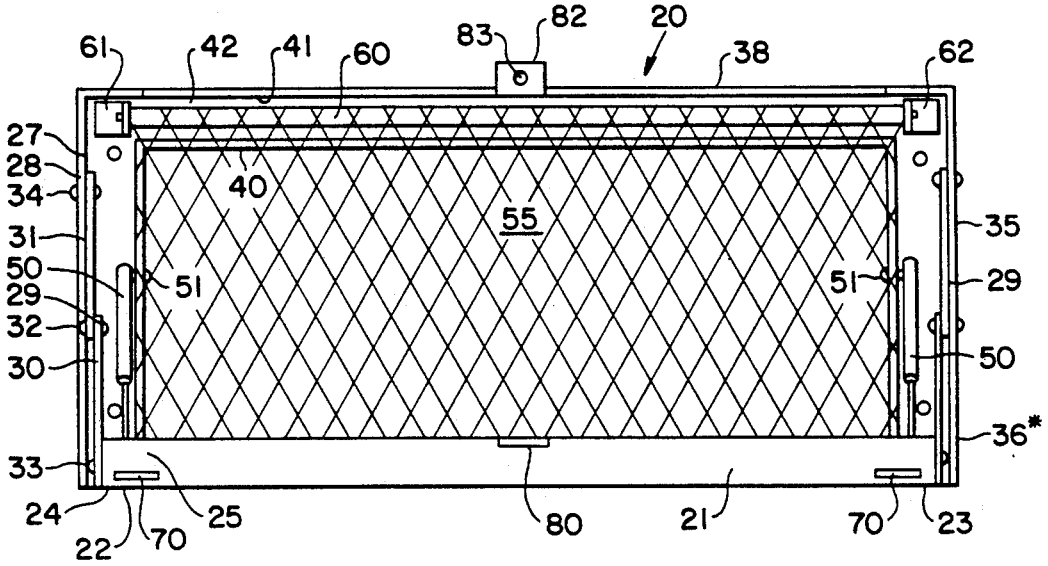
FIG. 4 is a top view of the soccer goal in FIG. 1.
Figure 13:
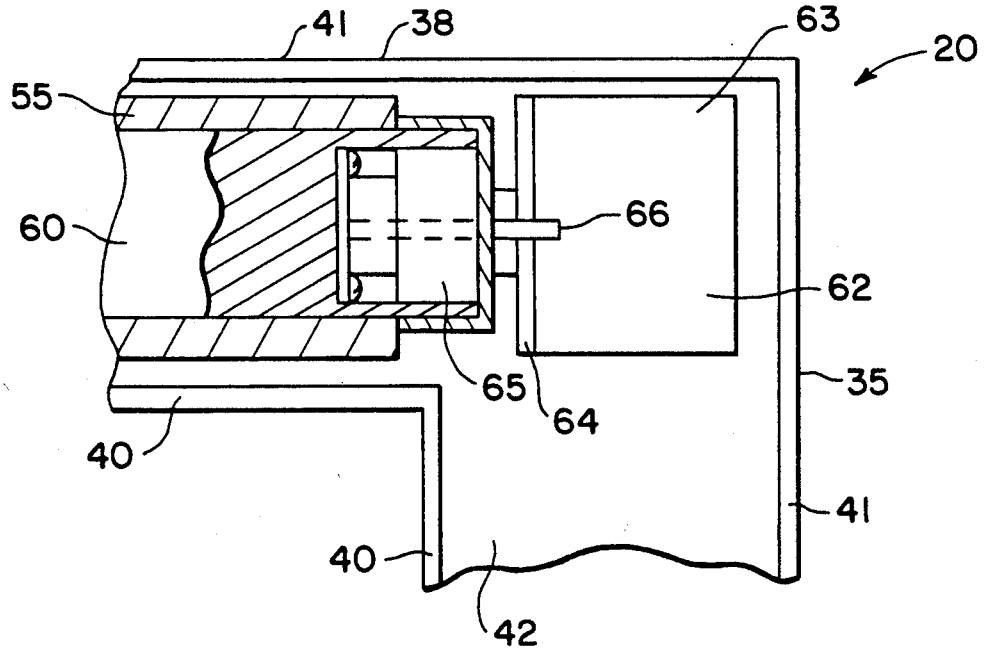
FIG. 13 is a detailed view showing the attachment of a net roller support structure in the soccer goal of FIG. 1.

In accordance with another aspect of this invention the back base 38 has a roller 60 supported in end frames 61 and 62, as particularly shown in FIGS. 1, 4 and 13. Referring to FIG. 13, the end frame 62 has a base 63 that can be welded or otherwise affixed to the bottom wall 42 of the back member 38 and an upright 64. The roller shade 60 includes a conventional window shade spring 65 with an extending axle 66 that the upright 64 supports. The axle 66 typically will be keyed in a slot in the upright 64 thereby to allow the spring 65 to be wound or compressed while the net 55 is being taken from the roller 60 and then to unwind and roll the net 55 onto the roller 60 when the cross bar 21 and goal post are lowered to a storage position.

Figure 11:
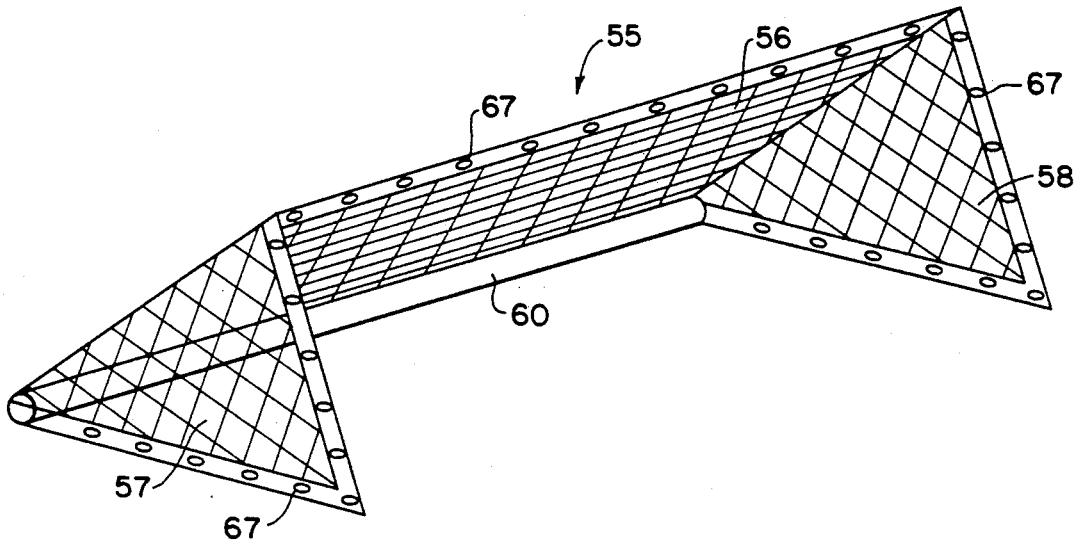
FIG. 11 is a perspective view of a net used with the soccer goal as it is oriented in a playing situation.
Figure 12:
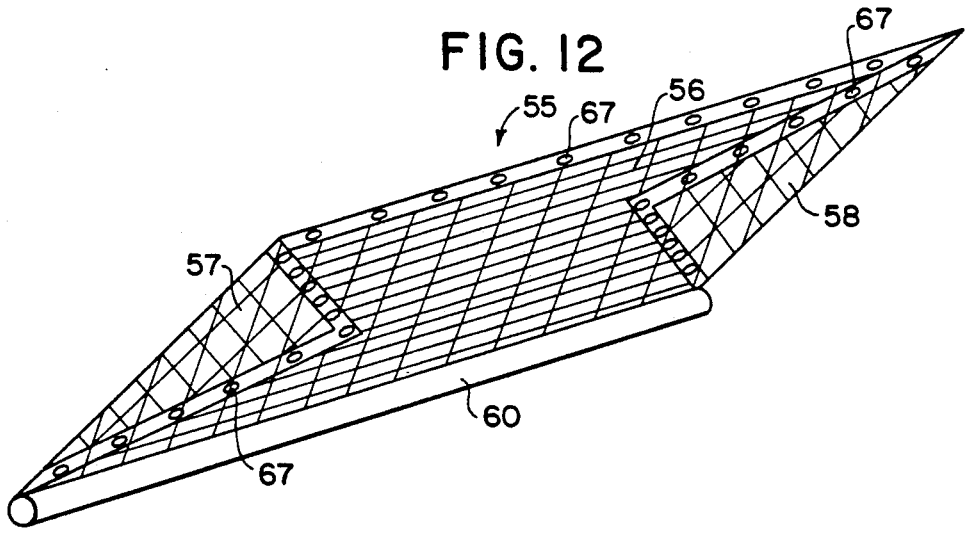
FIG. 12 is a perspective view of the net in FIG. 11 as it is prepared before the soccer goal is collapsed to a storage position.

As shown particularly in FIGS. 11 and 12, when the goal post is erect, the sides 57 and 58 are vertical and have a triangular shape. Referring particularly to FIG. 1, when the cross bar 21 and goal posts 22 and 23 are erect, a series of snaps or like fasteners 67 coact with the net to affix the edges of the net to the goal posts 22 and 23. Prior to storage, the side panels 57 and 58 are detached from the frame and rolled back onto the upper surface of the back 56 of the net 55. The net 55 then has an overall rectangular profile of the back 56 and is easily rolled onto the roller 60.

Figure 2:
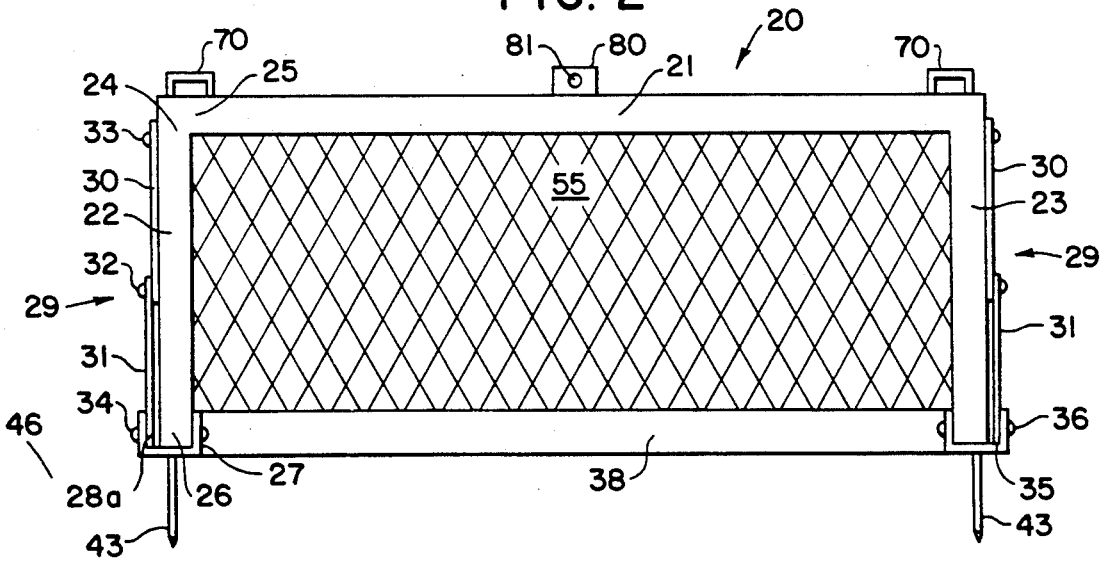
FIG. 2 is a front view of the soccer goal in FIG. 1.
Figure 7:
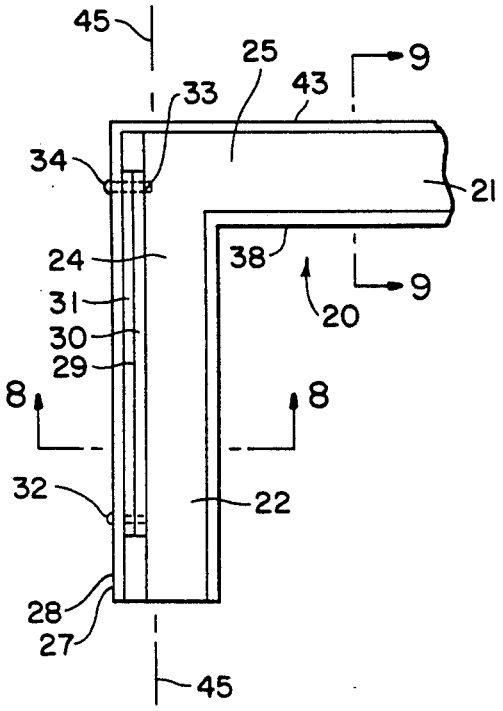
FIG. 7 is a top view of a corner portion of the soccer goal when it is fully collapsed.
Figure 10:
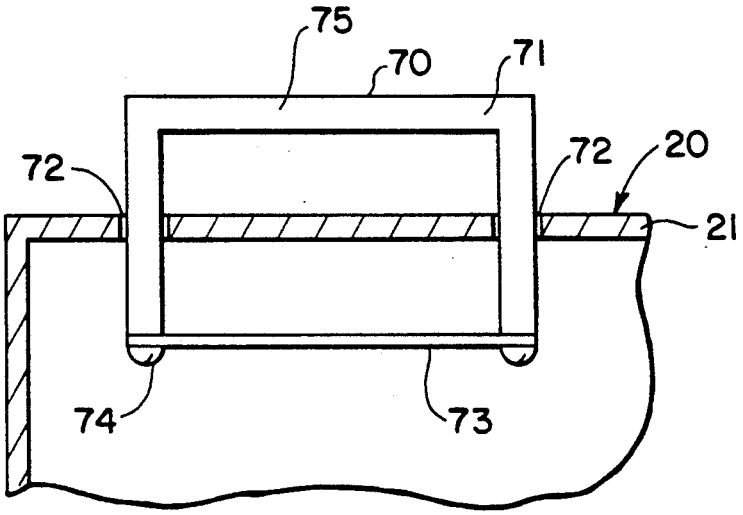
FIG. 10 is a detailed plan view of a handle that attaches to the soccer goal of FIG. 1.

As shown in FIGS. 2 and 4 and particularly FIG. 10, the step of raising or lowering the cross bar 21 and goal post 22 and 23 is additionally facilitated by the installation of handles 70 at the corners of or elsewhere along the cross bar 21. Each handle 70 has a U-shaped member 71, the legs of which pass through apertures 72 in the cross bar 21. A preventer 73 closes the U shape, so the handle 70 can not be removed from the cross bar 22. Screws or other fastening devices 74 secure the preventer to the U-shaped handle 70. When the goal posts 22 and 23 are in an erect position, the handles 70 drop by gravity so only the upper portion 75 of the handle 70 is exposed outside the cross bar 21.

Figure 14:
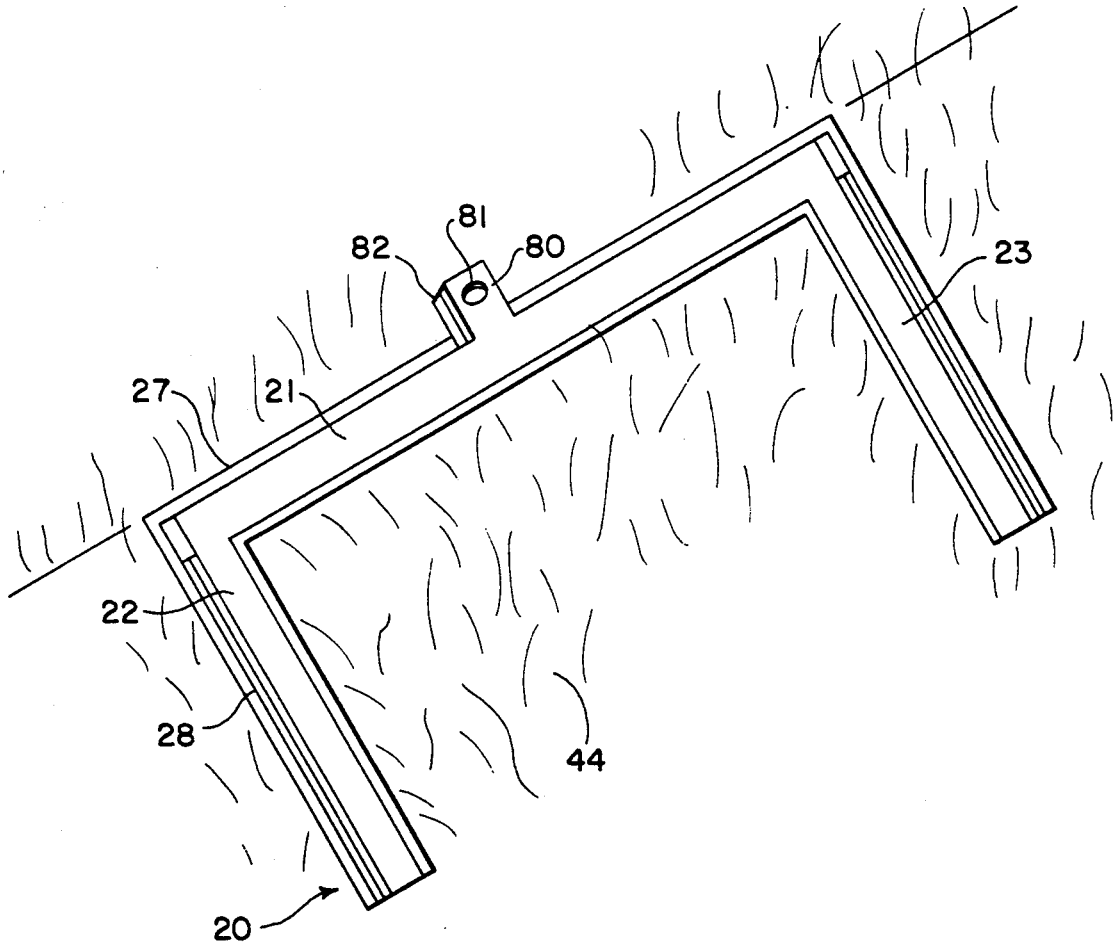
FIG. 14 is a perspective view of an installed soccer goal of FIG. 1 in its collapsed position.

As shown in FIGS. 1 through 5 and 14, a locking mechanism can be included with this structure. In this specific embodiment, a locking tab 80 extends from the cross bar 21 and contains a central aperture 81. Another locking tab 82 is formed integrally with the back member 38 and has an aperture 83. When the soccer goal is in its storage position, as shown in FIG. 14, the locking tabs 81 and 83 abut and the apertures, such as aperture 81, align. Then a standard lock can be inserted through the apertures 81 and 82 to secure the structure in the form shown in FIG. 14.

As shown particularly in FIGS. 1, 5, 6, 7 and 8, the toggle mechanisms 29 and gas cylinders 50 fold into the open top housing formed by the legs 28 and 35 and the base 38 when the goal posts 22 and 23 and cross bar 21 pivot into the storage position shown in FIG. 14. Thus, none of this structure protrudes above the profile as shown in FIG. 14.

When it is desired to use the goal, it is merely necessary to release any lock that holds the locking tabs 80 and 82 together. Two individuals grab the handles 70 and lift the goal posts to their upright position as shown in FIG. 1. As this occurs, the net, that is permanently connected to the cross bar 21, withdraws from the roller 60 while the roller spring assembly 65 tensions. Then the side flaps 57 and 58 are draped over the sides and connected at the fasteners 67. Thus the net assumes the general shape shown in FIG. 11. The spring assembly 65 maintains sufficient tension on the roller 60 to keep the back 56 of the net 55 taut. The toggles 29 provide a positive locking function to keep the goal posts 22 and 23 in a secure and upright position. The ground spikes 43 minimize the possibilities of dislodging the goal posts horizontally particularly when the base member 27 lies in a trench.

Figure 5:
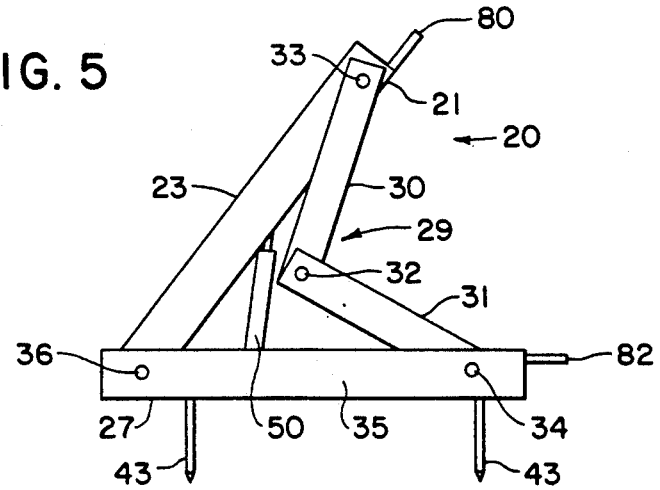
FIG. 5 is a side view of the soccer goal when it is partially collapsed.
Figure 9:
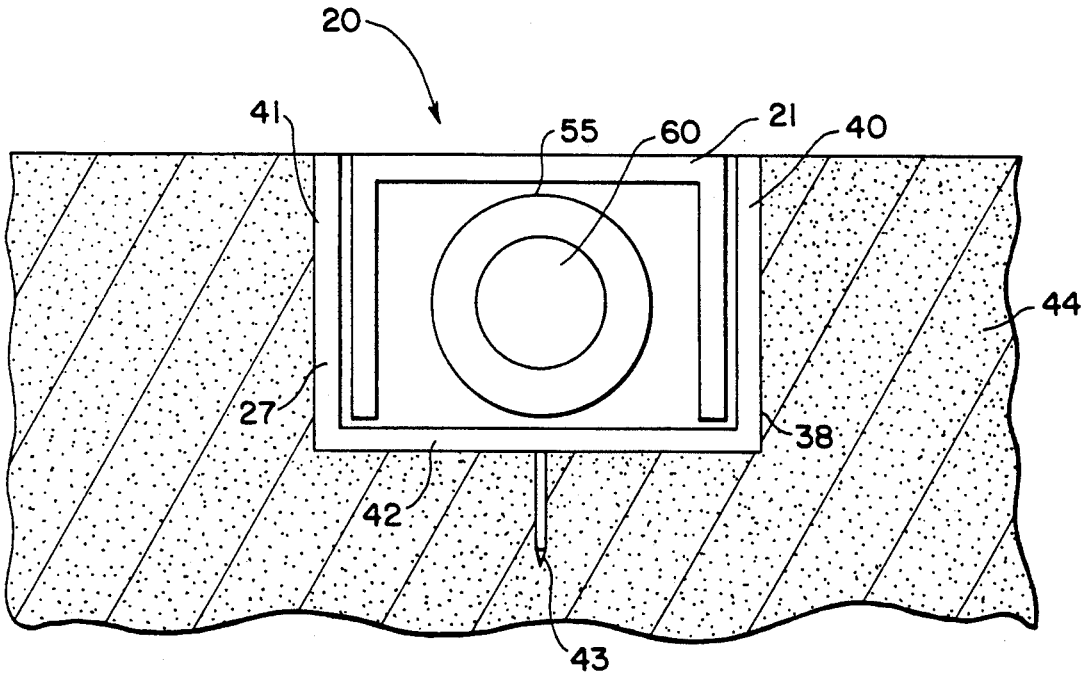
FIG. 9 is a cross-sectional view taken along lines 9—9 of FIG. 7.

When the soccer goal is no longer to be used, it is a simple matter to return it to a storage configuration. First the fasteners 67 are released and the net sides 57 and 58 are pulled outward and over on top of the back portion 56 of the net 55 so that the net 55 has a rectangular profile as shown in FIG. 5. Then the toggles 29 are released and the handles 70 are used to pull the cross bar 21 back toward the ground. The goal posts 22 and 23 will then rotate about the pivots, like the pivot 36. As the cross bar 21 moves toward the back channel 38, the roller 60 retrieves the entire net 55. Then the cross bar 21 is locked to the back member 38. In this position, particularly as shown in FIG. 9, the cross bar 21, if formed as a U-shaped channel opened to the back as shown in FIG. 1, covers the roller 60 and all the operating mechanism thereby to prolong its life.

Therefore in accordance with the objects and advantages of this invention, there has been provided a foldable goal post. It is easily converted between a playing position and a storage position. In the storage position it can be flush with the ground. It is also relatively easy to transport a soccer goal from one location to another as in its storage it is a compact structure due to its planar profile. The use of the extended ground pins that can be either rigidly affixed or threaded to the bottom wall 42 of the U-shaped channel 27 provides also a means of maintaining stability of the base member 27 even when the goal post rests on the surface of the ground.

As a result the two major detriments of stationary goal posts are overcome. Particularly, in the storage position shown in FIG. 14 it is not possible for an individual to grab the cross bar and topple the goal to the ground. Secondly, if the goal post is located in a trench formed in the ground as shown in FIGS. 9 and 14, the entire structure is flush with the ground and minimizes the possibility that some one will trip over or run into the goal post.

This invention has been defined in terms of a specific embodiment. It will be apparent that a number of variations can be made to this structure. For example, a different toggle mechanism might be used. The gas cylinders are optional and might be replaced with mechanical springs or eliminated all together. This particular embodiment is shown as being completed constructed with U-shaped channels, however, other frame configurations might be utilized for parts of the structure. All these changes and modifications can be made with the attainment of some or all of the inventions. Therefore it is the intent of the appended claims to cover all such variations and modifications as come within the true spirit and scope of this invention.

What is claimed as new and desired to be secured by Letters Patent of the United States is:

1. A soccer goal comprising:

A. a U-shaped, open-ended housing having leg means extending to free ends thereof and an open top for defining a U-shaped recess, B. a U-shaped open-ended frame means having leg means extending to free ends thereof, said the free ends of said legs of said housing and frame means being connected on a common axis whereby said U-shaped frame means can rotate relative to said housing, said frame means and housing being dimensioned so that said frame means can nest in said housing in a storage position, C. toggle means connected between said frame means and housing for allowing the relative displacement of said frame means and housing to an erect position and for releasably locking said frame means and housing in an essentially erect position, and D. net means attached to said frame means and housing for enclosing the sides defined by said frame means when said frame means is in the erect position whereby said leg means of said frame means constitute goal posts for the soccer goal.

2. A soccer goal as recited in claim 1 wherein said toggle means comprises first and second toggle mechanisms and said housing has the form of a U-channel to receive said toggle means in a folded configuration.

3. A soccer goal as recited in claim 1 wherein each of said U-shaped housing and frame means have a U-channel cross member extending between said corresponding leg means, said housing cross member having its opening facing the opening of said frame cross member to receive said frame cross member means when said frame means is in the storage position.

4. A soccer goal as recited in claim 3 wherein each of said leg means of said housing means is a U-channel with an opening facing said frame means for receiving said frame leg means and said toggle means therein when said frame means is in the storage position.

5. A soccer goal as recited in claim 3 wherein said net means comprises a net having back and first and second side portions, roller means rotatably supported in said housing cross member for storing said net, and fasteners connected to said side means and leg means of said frame means whereby said side portions are attached to said frame means when said frame means is in the erect position and are detached to facilitate storage of said net on said roller means.

6. A soccer goal as recited in claim 5 wherein said roller means comprises a spring activated roller having spring means for being placed under compression when the net is pulled from the roller means and for rolling said net onto said roller means when the frame means moves to the storage position.

7. A soccer goal as recited in claim 6 wherein said frame cross member has a U-channel with an opening facing said opening of said U-channel of said housing cross member whereby said frame cross member covers said net means when said frame means is the a storage position.

8. A soccer goal as recited in claim 1 additionally comprising gas cylinder means connected between corresponding leg means of said frame means and housing for assisting in the movement of said frame means between the storage and erect positions.

9. A soccer goal as recited in claim 8 wherein each of said toggle means has first and second toggle arms connected respectively to said corresponding leg means of said frame means and housing and has locking means for interacting with said arms in the extended position for locking said frame means in an erect position.

10. A soccer goal as recited in claim 9 wherein each of said gas cylinders and toggle arms pivots to the corresponding leg means whereby said toggle and gas cylinders fold into said leg means of said housing means when said frame means moves to the storage position.

11. A soccer goal as recited in claim 1 additionally comprising stake means depending from said housing for being driven into said ground thereby to provide horizontal stability to said soccer goal.

12. A soccer goal as recited in claim 1 additionally comprising handle means connected to said frame means for assisting in the transfer of said frame means between storage and erect positions.

13. A soccer goal as recited in claim 1 additionally comprising a second locking means connected to each of said housing and frame means for being in juxtaposition when said frame means is in the storage position thereby to provide a structure for locking said frame means and housing together in the storage position.

* * * * *